United States Patent [19]

Roberts

[11] 4,073,137

[45] Feb. 14, 1978

[54] CONVECTIVELY COOLED FLAMEHOLDER FOR PREMIXED BURNER

[75] Inventor: Richard Roberts, Marlborough, Conn.

[73] Assignee: United Technologies Corporation, Hartfort, Conn.

[21] Appl. No.: 692,172

[22] Filed: June 2, 1976

[51] Int. Cl.[2] ..... F02C 7/22

[52] U.S. Cl. ..... 60/39.32; 60/39.66; 60/39.72 R; 60/39.71; 60/39.65

[58] Field of Search ..... 60/39.65, 39.72 R, 39.66, 60/39.32, 39.69; 431/351, 352

[56] References Cited

U.S. PATENT DOCUMENTS

| | | | |
|---|---|---|---|
| 3,440,818 | 4/1969 | Quillevere et al. | 60/39.65 |
| 3,545,202 | 12/1970 | Batt et al. | 60/39.65 |
| 3,594,109 | 7/1971 | Penny | 60/39.65 |
| 3,899,876 | 8/1975 | Williamson | 60/39.65 |
| 3,918,255 | 11/1975 | Holden | 60/39.65 |
| 3,934,408 | 1/1976 | Irwin | 60/39.66 |
| 3,981,142 | 9/1976 | Irwin | 60/39.66 |

*Primary Examiner*—Carlton R. Croyle
*Assistant Examiner*—Robert E. Garrett
*Attorney, Agent, or Firm*—Charles A. Warren

[57] ABSTRACT

A flameholder is made of inner and outer wall members spaced apart for admission of coolant therebetween, the walls having aligned holes for the admission of fuel-air mixture from the space surrounding the flameholder to the space within the flameholder and the walls being held in spaced relation to one another by flanged tubes surrounding the holes in the outer wall and extending inwardly through the aligned holes in the inner wall, the tubes having lateral flanges on the inner ends overlying the inner surface of the inner wall.

9 Claims, 2 Drawing Figures

CONVECTIVELY COOLED FLAMEHOLDER FOR PREMIXED BURNER

BACKGROUND OF THE INVENTION

Uncooled, perforated sheet metal flameholders have various hole patterns to control the flow of fuel-air mixture therethrough but as such frequently over heat at high engine pressures and temperatures with resulting failure. Replacement with a double walled cooled structure the walls of which are secured together as a unit requires that the flameholder operate at a low temperature to avoid thermal fatigue, local unbonding and joint cracking because of the high thermal difference between inner and outer walls. The present invention provides the double wall, cooled construction but permits high temperature operation by supporting the inner wall within the outer wall without constraining relative thermal expansion between the walls. This invention permits a cooled flameholder without the thermal loading problems.

SUMMARY OF THE INVENTION

An object of the present invention is a double walled flameholder in which the thermal stresses in the structure are minimized thereby to avoid failure of the flameholder in high temperature operation. Another feature is a cooled double walled flameholder in which the inner wall is supported from the outer wall but not directly secured thereto so that the walls remain in desired relation but without such restraints on the inner wall as to cause excessive thermal stresses in either wall or in the supporting structure between the walls.

According to the present invention, the outer and inner walls have aligned holes for the flow of fuel-air mixture for combustion therethrough and are held in spaced relation to one another for the flow of coolant therebetween by sleeves on the outer wall surrounding the holes therein and extending inwardly through the aligned holes in the inner wall. The sleeves are a loose fit within the inner wall to permit relative expansion between the walls and lateral flanges on the sleeves engage the inner surface of the inner wall to assure the desired spacing between the walls. A construction of this type permits the use of different materials for inner and outer walls so that the outer (cooler) wall may be a high tenperature metallic alloy and the inner (hotter) wall may be a heat resistant material that is not necessarily high strength since it will receive its structural support from the outer wall.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

Figure 1:
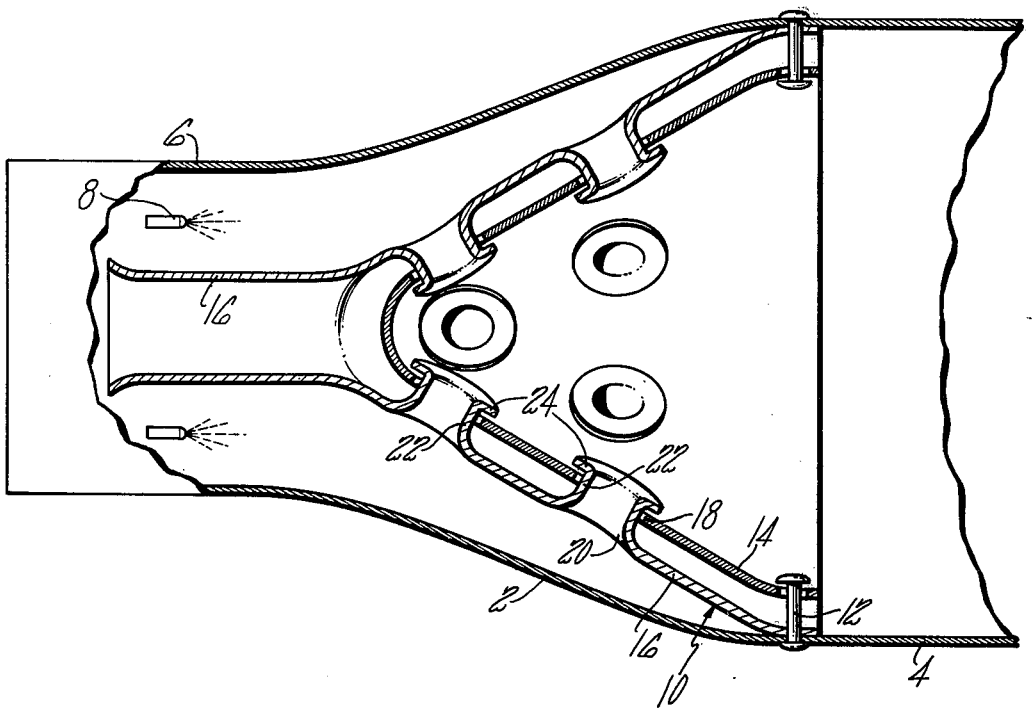
FIG. 1 is a sectional view through a conical flameholder incorporating the invention.

As shown in FIG. 1, the burner includes a housing 2 of generally conical configuration having an open discharge end 4. Air flow for combustion and flameholder cooling is admitted through a cylindrical inlet 6. In a premix-type burner, fuel is introduced upstream of the flameholder through injectors 8.

Within the conical housing is a conical flameholder 10 with its discharge end secured as by pins 12 to the open discharge end of the housing. The flameholder is a two-part element comprising an inner wall 14 and outer wall 16 in spaced relation to one another. The outer wall has a cylindrical inlet 16 within and spaced from the inlet 6 to the housing for admission of cooling air to the space between the flameholder walls.

The inner and outer walls of the flameholder have aligned holes 18 and 20 therein for the admission of the fuel-air mixture for combustion from the housing through the holes into the space within the flame tube where combustion takes place. The aligned holes 18 and 20 are not necessarily circular in configuration. The walls are held in predetermined relation to one another by annular flanges or sleeves 22 integral with the outer wall and surrounding the holes 20 therein. These sleeves extend inwardly from the peripheries of the holes 20 and project through the cooperating holes 18 in the inner wall, and are so dimensioned as to have a clearance within these holes 18 so that expansion between the two walls is not impeded. At the inner ends of the cylindrical flanges or sleeves 22 are lateral flanges 24 extending outwardly from the sleeves in a position to overlie the inner surface of the inner wall to limit excessive movement between the two walls. The flanges are not secured to the inner wall so that relative thermal expansion between the walls may occur without causing thermal stresses in either wall the walls being free of constrictive attachment. At the discharge end of the walls they are maintained in spaced relation to one another by the pins 12 so that a passage 26 exists between the walls for the discharge of cooling air.

This construction makes possible a much more durable flameholder since there are no welds or other attachments between the two walls at which points thermal stresses could cause severe cracking or other failure of either wall. Since no permanent connection such as welding is used between the walls it is unnecessary to make both walls of materials capable of being brazed, welded or otherwise physically bonded to one another. Thus the outer wall may be fabricated from a strong heat resistant metallic alloy such as dispersion strengthened nickel or some of the high strength, so-called superalloys and the inner wall may be fabricated from a material that is much more heat resistant, such as a ceramic material, and thus operable at much higher temperatures than the outer wall. The arrangement is such that the inner wall is subjected to only a small pressure differential and thus is pressure loaded to only a small degree.

With cooling air under pressure between the inner and outer walls a small amount will escape between the sleeves and the surrounding holes in the inner wall and will flow across the lateral flanges thereby cooling these flanges to an extent adequate to avoid destruction of these flanges. A construction of this character permits operation of the burner at a very high temperature by reason of the cooling of the flameholder and the construction of the flameholder to minimize thermal stresses and the shielding of the load carrying outer wall by the heat resistant inner wall which is so mounted as to be essentially free of thermal stresses.

Figure 2:
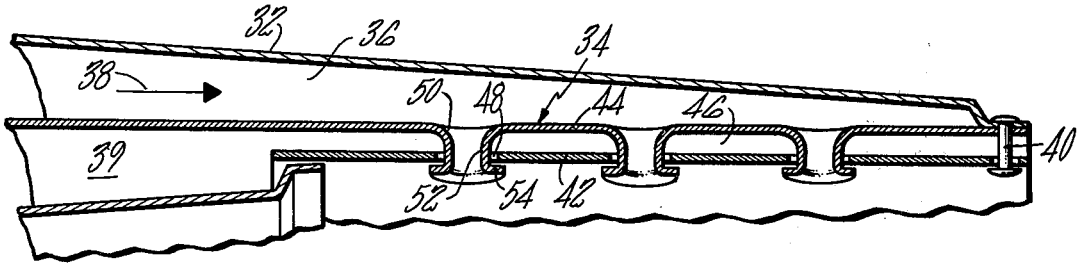
FIG. 2 is a sectional view of a portion of a burner utilizing a substantially cylindrical flameholder.

The invention is also applicable to cylindrical flameholders. As shown in FIG. 2, the burner housing 32 has the flameholder 34 positioned therein in spaced relation to the housing. Both the housing and flameholder shown are substantially cylindrical, only one wall of both housing and flameholder being shown. A mixture of fuel and air is introduced into the annular chamber 36 between the housing and flameholder, the flow entering in the direction of the arrow 38. Air for the purpose of cooling the flameholder is introduced into the annular chamber 39. The housing and flameholder are secured together at their downstream ends by suitable locating pins 40.

The flameholder is double walled, having an inner wall 42 and a surrounding outer wall 44. These walls are spaced apart to provide a cooling air space 46 therebetween and both walls have cooperating aligned holes 48 and 50 in inner and outer walls, respectively. From the periphery of the holes 50 in the outer wall are integral inwardly extending sleeves or flanges 52 extending through the holes 48 in the inner member with clearance between the sleeves and the periphery of the holes 48. The inner ends of the sleeves have laterally extending integral flanges 54 to overlie the inner wall on the inner side thereof. Thus, these sleeves and lateral flanges hold the inner and outer wall in spaced relation to one another without creating any stresses in either wall. As in the arrangement of FIG. 1 the inner wall is not welded or otherwise attached to the sleeves or flanges so that relative thermal expansion may occur without creating any thermal stresses.

Further, as in FIG. 1, since the parts are not integrally secured or permanently attached to one another the range of materials for the two walls is less restricted since the inner wall may be a material that is not necessarily capable of being welded or brazed to the material of the outer wall. Thus the outer wall may be a high strength, high temperature metallic alloy, if desired, such as many of the so-called superalloys used in the hot areas of gas turbine engines or other hot-strength material such as dispersion strengthened nickel and the inner wall may be a heat resistant material of significantly different material as for example certain of the ceramics which are not damaged by high-temperature environments. Alternatively, under certain conditions, the inner wall may be porous so that this wall may be transpirationally cooled by the escape of a part of the cooling air through the pores of the wall. As will be apparent, there is no significant pressure differential across the inner wall and in the arrangement shown the higher pressure is on the outer surface of the inner wall so that this wall would be loaded only in compression. It will be understood that the cooling air flow between the walls is at a slightly higher pressure than that within the flame tube and generally substantially the same as that in the chamber 36 surrounding the flame tube.

The dimensions of the walls of the flame tubes and of the connecting sleeves and lateral flanges are such that relative thermal expansion during burner operation will not apply any significant load on either wall and it is expected that under all conditions of operation there will be a small amount of cooling air flowing through the space between each sleeve and the associated hole in the inner wall, and this cooling air will then flow between the inner surface of the inner wall and the overlying flange to serve to cool these flanges to some extent.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of my invention, that which I claim as new and desire to secure by Letters Patent of the United States is:

1. A flameholder for a burner construction including
an inner wall structure having holes therein for the flow of gas therethrough,
an outer wall member coextensive with and in spaced relation to the inner wall and having holes therein in alignment with the holes in the inner wall,
said outer wall having integral annular flanges projecting inwardly from the periphery of the holes therein and extending through the aligned holes in the inner wall, said annular flanges being smaller in diameter than the holes receiving them to provide a clearance therebetween, and
lateral flanges integral with and on the inner ends of the annular flanges to overlie the inner wall on the inner side thereof in closely spaced relation thereto, said flanges being free of constrictive attachment to the inner wall and constituting the attachment means by which the walls are held in operative position.

2. A flameholder as in claim 1 including means for supplying cooling air to the space between the walls.

3. A flameholder as in claim 1 in which the outer wall is in surrounding parallel relation to the inner wall.

4. A flameholder as in claim 1 in which the outer wall is a high temperature, high-strength material and the inner wall is a heat resistant material.

5. A flameholder as in claim 4 in which the outer wall is a high strength metallic alloy and the inner wall is a ceramic material.

6. A flameholder for positioning within a burner, the latter including a housing to which combustible fuel-air mixture is supplied, said flameholder including
an outer wall positioned within and spaced from the housing,
an inner wall located within and in spaced relation to the outer wall to define a cooling space therebetween,
said inner and outer walls having aligned openings therein for admitting the combustible mixture to the space combustion chamber within the inner wall,
said outer wall having integral inwardly extending sleeves thereon surrounding at least some of the holes therein and projecting inwardly through the aligned holes in the inner wall, the sleeves being smaller in diameter than the holes receiving them to provide a clearance therebetween, and
lateral flanges on the inner ends of the sleeves to overlie the inner surface of the inner wall adjacent the holes therein, said flanges being free of attachment to the inner wall and being closely spaced from the inner wall to provide a clearance therebetween.

7. A flameholder as in claim 6 including means for supplying coolant to the space between the walls.

8. A flameholder as in claim 6 in which the outer wall is a high temperature, high-strength material and the inner wall is a heat resistant material.

9. A flameholder as in claim 6 in which the outer wall is a high strength metallic alloy and the inner wall is a heat resistant ceramic.

* * * * *